United States Patent [19]

Wigfall

[11] 3,965,532

[45] June 29, 1976

[54] HINGES

[75] Inventor: Douglas Mervyn Wigfall, Holcombe Brook, near Bury, England

[73] Assignee: Crompton, Nettlefold Stenman Limited, Wigan, England

[22] Filed: July 23, 1975

[21] Appl. No.: 598,364

[30] Foreign Application Priority Data

Aug. 1, 1974 United Kingdom ..... 33935/74
Jan. 20, 1975 United Kingdom ..... 2463/75

[52] U.S. Cl. ..... 16/149; 16/181
[51] Int. Cl.[2] ..... E05D 7/12
[58] Field of Search ..... 16/128 R, 171, 149, 16/175, 150, 159, 174, 139, 140, 141, 142, 143, 144, 145, 180, 181, 158, 178

[56] References Cited

UNITED STATES PATENTS

| | | | |
|---|---|---|---|
| 1,340,430 | 5/1920 | Wright | 16/149 |
| 2,207,836 | 7/1940 | Sundell | 16/149 |
| 2,488,882 | 11/1949 | Shealey | 16/171 |
| 3,005,228 | 10/1961 | Friend | 16/171 |
| 3,284,844 | 11/1966 | Seckerson | 16/171 |
| 3,423,786 | 1/1969 | Arias et al. | 16/171 |
| 3,728,758 | 4/1973 | Johansen | 16/149 |

*Primary Examiner*—George V. Larkin
*Attorney, Agent, or Firm*—Merriam, Marshall, Shapiro & Klose

[57] ABSTRACT

A hinge for pivotally connecting two components, the hinge being in the form of two pivotally interconnected leaves and a casing, one leaf being arranged to be secured to one component and the casing being arranged to be secured to the other component. The casing provides a socket having opposed walls between which the other leaf can slide, one of the walls of the casing and the other leaf having complementary formations which interengage with a snap action to hold the other leaf in the socket and the one wall of the casing being arranged to lie between the other leaf and the other component when the hinge is in use.

12 Claims, 9 Drawing Figures

HINGES

BACKGROUND OF THE INVENTION

This invention relates to hinges and particularly hinges for use in mounting doors within door frames.

With the mass production of many items for the building trade such as doors and door frames, there is a requirement for a two-piece hinge, one part of which can be secured in the factory to the door and the remaining part of which can be secured in the factory to the frame and which will allow the speedy uniting of the two parts in order to mount the door on the frame at the building site.

It is an object of the present invention to provide a hinge which can be used in the manner described above.

SUMMARY OF THE INVENTION

According to the present invention we provide a hinge for pivotally connecting two components, said hinge comprising two pivotally inter-connected leaves and a casing, one leaf being arranged to be secured to one component, the casing being arranged to be secured to the other component and to provide a socket having opposed walls between which the other leaf can slide, one of the walls and said other leaf having complementary formations which interengage with a snap action to hold said other leaf in the socket when said leaf has entered the socket to a predetermined extent, said one wall being arranged to lie between said other leaf and the other component when the hinge is in use.

The complementary formations may comprise a resilient projection on said one wall and an aperture in said other leaf. Preferably the formations are arranged to be disengageable to permit the removal of said other leaf from the socket.

For example, the other wall of the casing may be apertured at a position overlying the resilient projection in order to allow a tool to be inserted through the aperture in the other wall to depress the resilient projection to allow disengagement of the aperture in said other leaf. The above operation of disengaging the projection and aperture can be simplified by providing the free end of the other leaf with a slot in alignment with the aperture in the other wall and which extends from the aperture to the free end of the other leaf. This will allow the projection to be depressed by the tool throughout the removal of the other leaf from the socket.

In order to provide a more robust arrangement the other leaf may be arranged to be supported by the other wall of the casing against movement away from said other wall in directions substantially perpendicular thereto when said other leaf has entered the socket to said predetermined extent.

This can be achieved, for example, by providing the other leaf with formation which projects therefrom and is arranged to enage the other wall in order to support said other leaf on the other wall.

In a further arrangement the other wall may be provided with a pair of lugs arranged to extend between said other leaf and said one wall in order to support said other leaf on the other wall.

In a hinge in accordance with the present invention the casing may be arranged to be secured in a recess in the surface of the other component, said casing being arranged to be secured in contact with the bottom of the recess and having an outer face arranged to close the recess by lying substantially in the plane of the surface of the other component.

For example, if hinges in accordance with the present invention are used to hang a door, the casings may be recessed into the door so that they do not project therefrom and a number of such doors may therefore be stacked on top of each other without the risk of damage by any projecting hinge part. This is particularly important in the modern mass production situation in which unacceptable damage can easily be caused to doors during storage by projecting hinge knuckles etc.

If the casings are mounted symmetrically on the door, the door will be suitable for right or left hard hanging, thus reducing the need for the door manufacturer to carry stocks of both types of door.

BRIEF DESCRIPTION OF DRAWINGS

Several embodiments of the present invention will now be described with reference to the accompanying drawings in which.

DESCRIPTION OF PREFERRED EMBODIMENTS

Figure 1:
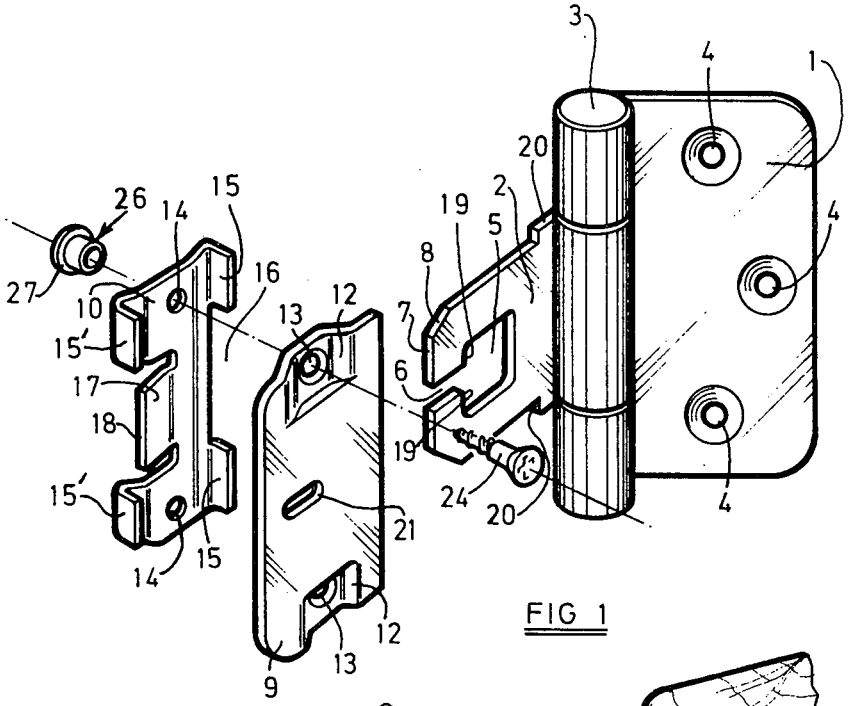
FIG. 1 is a perspective partly exploded view of a hinge embodying the present invention.

Referring to FIG. 1 the hinge comprises two leaves 1 and 2 pivotally inter-connected by a hinge pin 3. The leaf 1 is provided with countersunk screw holes 4 by which it may be secured to one of the components to be hingedly connected. The other hinge leaf 2 is provided with an aperture 5 and a longitudinally extending slot 6 which connects the aperture 5 to the free end 7 of the leaf. The free end of the leaf 2 is also chamfered at 8.

The hinge is completed by a casing comprising first and second members in the form of an inner retaining member 10 of spring steel and an outer plate 9 of thicker non-resilient sheet metal. The outer plate and retaining member are arranged to be secured, in a superimposed relationship as shown more clearly in FIG. 2, to the other component which is to be hingedly connected.

The outer plate 9 is spaced from the retaining member 10 by a distance substantially equal to the thickness of the hinge leaf 2 so that the opposed faces of the plate and retaining member define a socket therebetween. This spacing is achieved by the provision of depressions 12 in the outer plate which include countersunk holes 13 which are in alignment with corresponding holes 14 in the retaining member. The retaining member 10 is also provided with two pairs of spaced, outwardly-turned flanges 15 and 15' which abut the inner face of the outer member 9.

An eyelet 26 extends through one pair of aligned holes 13 and 14 in order to secure the outer plate 9 to the retaining member 10. The eyelet has a head portion 27 and is inserted first through the hole 14 and then after passing through the hole 13 has its free end opened out to cooperate with the countersunk hole 13 and provide a seating for a screw 24 by which the outer plate and retaining member may be secured to the component on which they are to be mounted. If desired the eyelet 26 may be dispensed with and the outer plate 9 and retaining member 10 may simply be secured together in superimposed relationship on the component by screws such as 24 extending through the holes 13 and 14. Alternatively, an eyelet may be arranged to extend through each respective pair of aligned holes 13 and 14.

The hinge leaf 2 can be introduced into the socket formed between the outer plate 9 and the retaining member 10 via the gap 16 between the flanges 15 which forms the mouth of the socket.

The retaining member is also provided with a resilient projection in the form of a tongue 17 which extends away from the retaining member into the socket in a direction away from the mouth 16 of the socket. The tongue 17 is arranged to cooperate with the aperture 5 in the hinge leaf 2 so that when the end of the leaf 2 is inserted into the socket the tongue 17 is initially depressed by the free end of the hinge leaf until the hinge leaf has been inserted into the socket sufficiently to allow to tongue 17 to snap back into the aperture 5. In this position removal of the hinge leaf 2 from the socket is prevented by abutment between the edge 18 of the tongue 17 and the adjacent edge portions 19 of the aperture 5. The hinge leaf 2 is provided with shoulders 20 which contact the flanges 15 on the retaining member 10 thus limiting the extent to which the hinge leaf 2 may be inserted into the socket. Ideally, the shoulders 20 are arranged to contact flanges 15 at the instant the tongue 17 snaps into the aperture 5.

In order to allow removal of the hinge leaf 2 from the socket the outer plate 9 is apertured at 21. This aperture 21 overlies the tongue 17 and hence enables a screw driver 25 or a similar tool to be introduced through the slot 21 in order to depress the tongue 17 sufficiently to allow the removal of the hinge leaf 2. The slot 6 in the hinge leaf 2 is aligned with the aperture 21 in the outer plate 9 and allows the downward force applied to the tongue 17 to be maintained throughout the removal of the hinge leaf 2 from the socket. This greatly facilitates the removal of the hinge leaf.

Figure 2:
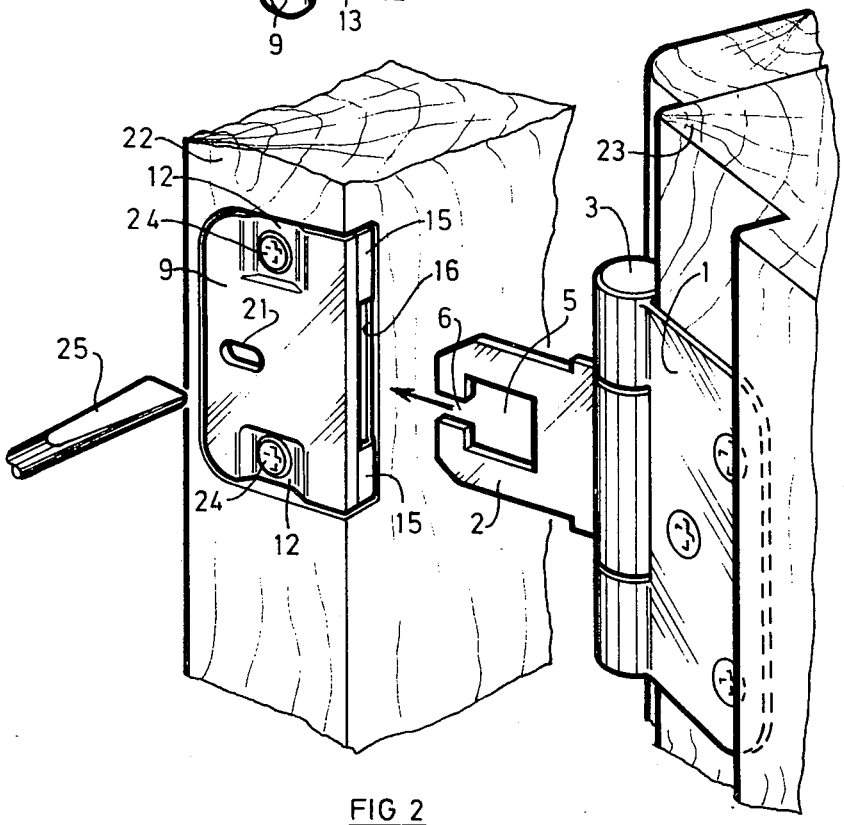
FIG. 2 is a perspective view of the hinge shown in FIG. 1 as used to hang a door in a door frame.

FIG. 2 shows the use of the hinge to hang a door 22 within a door frame 23. The outer plate 9 and retaining member 10 are secured to the door 22 by screws 24 which extend through the aligned apertures 13 and 14. The retaining member and outer plate are recessed into the door so that the retaining member contacts the base of the recess and the outer surface of the outer plate 9 is flush with the outer surface of the door. Since the recessed outer plate and retaining member do not project from the door, doors fitted with such recessed outer plates and retaining members can be stacked on top of each other without any danger of damaging each other due to projecting hinge parts.

The door may be speedily mounted on the door frame by the insertion of the hinge leaf 2 into the socket via the mouth 16. As described above the resilient tongue 17 will then engage the aperture 5 in the hinge leaf and hence lock the door in position on the hinge leaf 2. If it is desired to remove the door from the door frame the resilient tongue 17 is depressed using a screwdriver 25 as previously described in order to enable the hinge leaf 2 to be withdrawn from the socket.

Although in the arrangement described above the hinge is made entirely from metal material all the hinge components with the exception of the pivot pin 3 can, if so desired, be manufactured from plastics material such as nylon. This also applies to the various arrangements shown in FIGS. 3 to 8.

Figure 3:
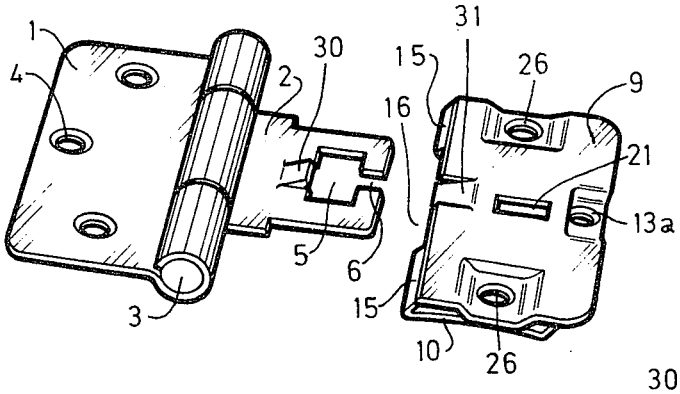
FIGS. 3 and 4 show perspective views of a modified form of the hinge shown in FIGS. 1 and 2.
Figure 4:
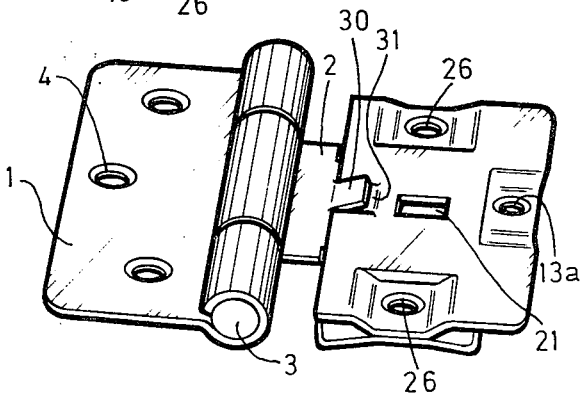

FIGS. 3 and 4 show a modified form of the hinge described above which is designed to carry heavier loads. Those components of the modified hinge shown in FIGS. 3 and 4 which have the same function as the components of the hinge shown in FIGS. 1 and 2 have been similarly numbered.

The outer plate 9 is again secured to the retaining member 10 at two locations by eyelets 26. The plate 9 is, however, wider than the plate 9 shown in FIGS. 1 and 2 and is provided with an additional countersunk hole **13*a* which does not overlie the retaining member 10 and through which the plate 9 can be secured to the associated component such as the door 22 of FIG. 2. Also, the hinge leaf 2 of the hinge shown in FIGS. 3 and 4 is provided with a raised tongue portion 30 which is pressed outwardly and which is arranged to cooperate with a corresponding downwardly pressed portion 31 of the outer plate 9.**

FIG. 4 shows the hinge in the assembled condition with the leaf 2 inserted into the socket and the raised tongue 30 engaging the pressed portion 31 of the outer plate 9. The retaining member 10 is provided with a resilient tongue 17 (not shown), as described above in relation to FIGS. 1 and 2, which engages the aperture 6 in the hinge leaf 2 when the hinge leaf is inserted into the socket between the outer plate 9 and retaining member 10 as shown in FIG. 4.

By providing the hinge leaf 2 with the raised tongue 30 which cooperates with the pressed portion 31 on the outer plate 9, the hinge is made more robust since the hinge leaf 2 is supported directly on the outer plate 9 which is stronger than the spring steel retaining member 10. Thus movement of the hinge leaf 2 away from the outer plate 9 in a direction substantially perpendicular thereto is resisted by the outer plate 9 rather than the retaining member 10. This increases the carrying capacity of the hinge since without the tongue 30 and pressed portion 31 the retaining member 10 tends to bow outwardly away from the outer plate 9 under heavy loads.

Figure 5:
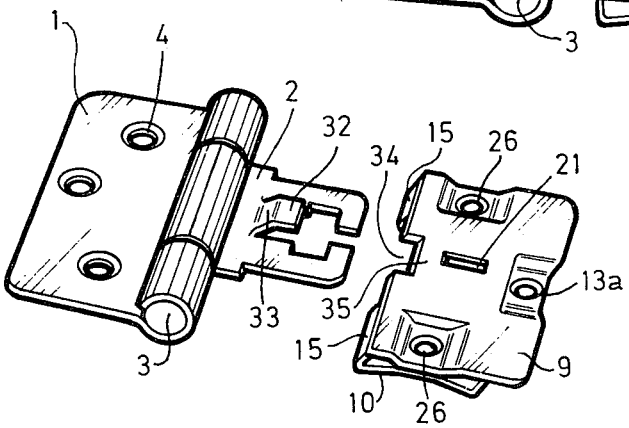
FIGS. 5 and 6 show perspective views of a further modified form of the hinge shown in FIGS. 1 and 2.
Figure 6:
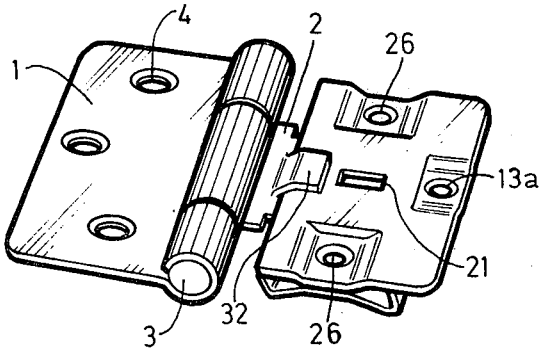

FIGS. 5 and 6 show a further modified form of the hinge shown in FIGS. 1 and 2 in which the hinge leaf 2 is again arranged to take support from the outer plate 9. In the arrangement shown in FIGS. 5 and 6, the hinge leaf 2 is provided with a raised tongue 32. This tongue has a neck portion 33 which is arranged to enter a slot 34 in the outer plate 9 when the leaf 2 is inserted into the socket as shown in FIG. 6. With the hinge in its operational condition shown in FIG. 6, the tongue 32 overlies the portion 35 of the outer plate 9 and the neck 33 extends within the slot 34. The leaf 2 is thus supported on the outer plate 9 against movement away from the outer plate 9 in directions substantially perpendicular thereto. The remaining constructional details of the hinges are identical to that previously described above in relation to FIGS. 3 and 4.

Figure 7:
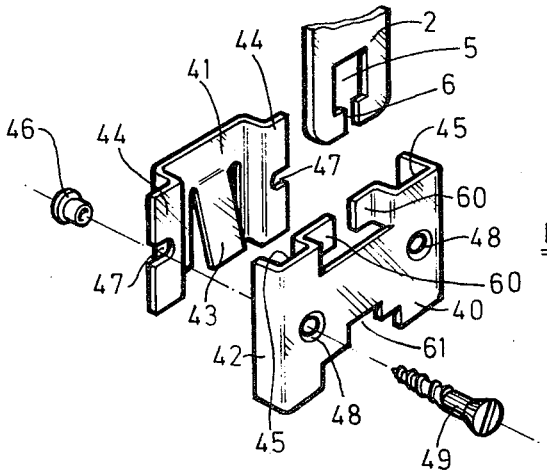
FIGS. 7 and 8 show perspective views, FIG. 7 being exploded, of part of a further form of hinge embodying the present invention.
Figure 8:
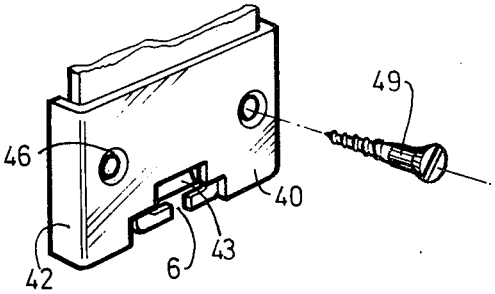

FIGS. 7 and 8 show part of a third form of hinge embodying the present invention in which the casing is of a different construction. In the arrangement shown in FIGS. 7 and 8 the casing comprises an outer plate 40 and a spring-steel retaining member 41. The outer plate is provided with downwardly turned flanges 42 which are arranged to contact the component to which the casing is secured. The retaining member 41 is provided with a resilient tongue 43 and flange portions 44 which are arranged to contact internal surfaces 45 on the outer member 40. The outer member 40 and retaining member 41 are secured together by eyelets 46 which extend through aligned slots and holes 47 and 48 in the retaining member and outer member respectively. The casing is arranged to be secured to the component by screws 49 which extend through the eyelets 46.

The outer member 40 is provided with a pair of lugs 60, arranged to extend between the hinge leaf 2 and the retaining member 41 when the hinge leaf is inserted into the casing. The lugs 60 thus support the hinge leaf 2 on the outer member 40 against movement away from the outer member in directions substantially perpendicular thereto. The outer member is provided with a slot 61 which overlies the end of the tongue 43 and through which a tool may be inserted in order to depress the end of the tongue 43 thereby releasing the tongue from the aperture 5 in the hinge leaf 2 as described above.

Although the invention has been decribed above in relation to a butt hinge it will be understood that the invention is applicable to spring hinges, that is hinges in which a spring is connected between the leaves so as to tend to restore the hinge to its closed position and to door closure units which are provided with two leaves whereby the unit may be connected to a door and to a door post in order to bias the door to its closed position. Reference in the above description and the following claims to "hinges" should be accordingly construed as covering all types of hinges including spring hinges and door closure units.

Figure 9:
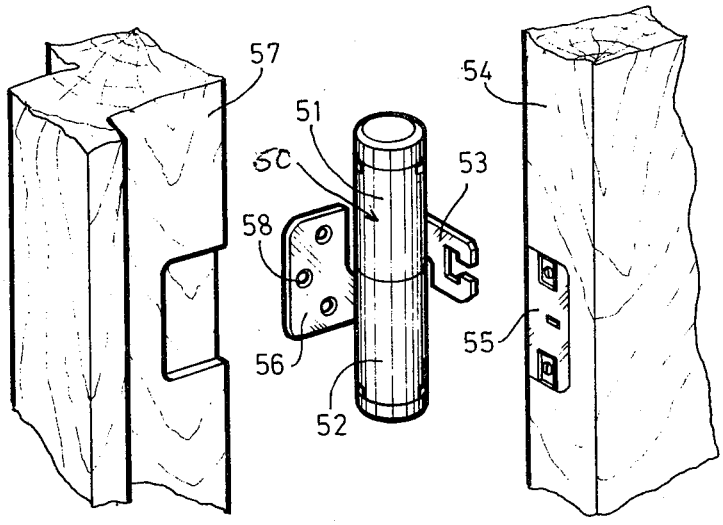
FIG. 9 is a perspective view, partly exploded, of a hinge in the form of a door closure unit embodying the present invention.

FIG. 9 shows the present invention applied to a door closure unit 50 which is provided with an outer sleeve or casing in the form of two tubes 51 and 52. The tube 51 is provided with a leaf 53 for attachment to a door 54 using a casing 55 as previously described in relation to FIGS. 1 and 2. The other tube 52 is provided with a leaf 56 which is arranged to be attached to a door post 57 by screws not shown passing through holes 58. A torsion spring is housed within the tubes 51 and 52 and biases the door 54 to its closed position.

In the various arrangements described above only one of the leaves of the hinge is secured in its operational position using the casing provided with a resilient project which engages an aperture in the tongue. The other leaf of the hinge may be secured to the other component by any suitable means and, if desired, both leaves of the hinge may be secured to their respective components using the casing arrangements described above.

The present invention thus provides a hinge which will enable the easy mounting of a door on a door frame at a building site. Also, by recessing the casing into the door as shown in FIG. 2, doors may be stacked on top of each other without the risk of damage by any projecting hinge part.

I claim:

1. A hinge for pivotally connecting two components, said hinge comprising two pivotally inter-connected leaves and a casing, one leaf being arranged to be secured to one component, the casing being arranged to be secured to the other component and to provide a socket having opposed walls between which the other leaf can slide, one of the walls and said other leaf having complementary formations which interengage with a snap action to hold said other leaf in the socket when said leaf has entered the socket to a predetermined extent, said one wall being arranged to lie between said other leaf and the other component when the hinge is in use.

2. A hinge according to claim 1 in which the formations comprise a resilient projection on said one wall and an aperture in said other leaf.

3. A hinge according to claim 2 in which the resilient projection is arranged to be disengageable from the aperture in order to allow removal of said other leaf from the socket.

4. A hinge according to claim 3 in which the other wall of the casing is apertured at a position overlying the resilient projection in order to allow a tool to be inserted through the aperture in the other wall to depress the resilient projection to allow disengagement of the aperture in said other leaf member.

5. A hinge according to claim 4 in which the free end of said other leaf is provided with a slot in alignment with the aperture in the other wall and which extends from the aperture in the other leaf to the free end thereof thus allowing the resilient projection to be depressed by the tool throughout the removal of the other leaf from the socket.

6. A hinge according to claim 4 in which said other leaf is arranged to be supported by the other wall of the casing against movement away from said other wall in directions substantially perpendicular thereto when said other leaf has entered the socket to said predetermined extent.

7. A hinge according to claim 6 in which said other leaf is provided with a formation which projects therefrom and is arranged to engage the other wall in order to support said other leaf on the other wall.

8. A hinge according to claim 6 in which the other wall is provided with a pair of lugs arranged to extend between said other leaf and said one wall in order to support said other leaf on the other wall.

9. A hinge according to claim 1 in which the casing is arranged to be secured in a recess in the surface of the other component, said casing being arranged to be secured in contact with the bottom of the recess and having an outer face arranged to close the recess by lying substantially in the plane of the surface of the other component.

10. A hinge according to claim 1 in which the casing is formed from first and second members arranged in a superimposed relationship, said members defining the socket therebetween, the first member providing said one wall and the second member the other wall.

11. A hinge according to claim 10 in which the first member is made from spring steel, and provides a resilient projection in the form of a tongue portion which projects from the first member and is arranged to engage an aperture in said other leaf, and in which the second member is formed from non-resilient material.

12. A hinge according to claim 10 in which the first and second members are secured together by at least one eyelet, said eyelet providing an aperture through said casing whereby said casing may be secured to the other component.

* * * * *